United States Patent [19]

Cappel et al.

[11] 4,393,775

[45] Jul. 19, 1983

[54] ARRANGEMENT FOR METERING THE INK QUANTITY IN INKING UNITS ON PRINTING PRESSES

[75] Inventors: Bert Cappel; Gunther Schniggenfittig, both of Mulhein; Siegfried Schuhmann, Offenbach am Main, all of Fed. Rep. of Germany

[73] Assignee: M.A.N.-Roland Druckmaschinen Aktiengesellschaft, Fed. Rep. of Germany

[21] Appl. No.: 289,365

[22] Filed: Aug. 3, 1981

[30] Foreign Application Priority Data

Aug. 14, 1980 [DE] Fed. Rep. of Germany ..... 3030774

[51] Int. Cl.[3] ..... B41F 31/02; B41F 1/46

[52] U.S. Cl. ..... 101/365; 101/155; 101/167; 101/363

[58] Field of Search ..... 101/157, 365, 169, 363, 101/155, 167

[56] References Cited

U.S. PATENT DOCUMENTS

| | | | |
|---|---|---|---|
| 3,895,575 | 7/1975 | Cappel et al. | 101/363 |
| 3,913,479 | 10/1975 | Cappel et al. | 101/365 |
| 3,930,445 | 1/1976 | Jaffa | 101/157 X |
| 3,978,788 | 9/1976 | Cappel et al. | 101/363 |
| 4,058,058 | 11/1977 | Hantscho | 101/364 X |
| 4,232,601 | 11/1980 | Mitter | 101/169 X |

FOREIGN PATENT DOCUMENTS

| | | | |
|---|---|---|---|
| 235768 | 6/1911 | Fed. Rep. of Germany . | |
| 808318 | 8/1951 | Fed. Rep. of Germany | 15/256.5 |
| 1121074 | 1/1962 | Fed. Rep. of Germany | 101/157 |
| 2460116 | 7/1976 | Fed. Rep. of Germany . | |
| 2937037 | 3/1981 | Fed. Rep. of Germany . | |
| 978988 | 1/1965 | United Kingdom | 15/256.51 |

*Primary Examiner*—Edward M. Coven
*Assistant Examiner*—John A. Weresh
*Attorney, Agent, or Firm*—Leydig, Voit, Osann, Mayer & Holt, Ltd.

[57] ABSTRACT

An ink fountain including a frame defining a horizontal slot adjacent the fountain roller. Arranged side by side in the slot is a metering assembly in the form of a series of flat slides each having a cam assembly at its rear end for adjusting the position of the slide with respect to the fountain roller thereby to meter ink in predetermined thickness in respective zones. Each slide is formed of a body having secured thereto a rectangular tip portion formed of resilient plastic. The tip portion of each slide has embedded in it a blade of wear resistant spring metal, the blade being coextensive with the width of the slide and so oriented as to present a flat face to the fountain roller defining, with the fountain roller, a sharply acute cusp. The rectangular tip portion of each slide is relieved in the region just behind the spring metal blade to permit the blade to flex broadwise resiliently and accommodatingly when the slide is advanced to bring the edge of the blade against the surface of the fountain roller thereby to achieve a seal between the blade and the fountain roller with only limited reaction force being exerted between them.

5 Claims, 7 Drawing Figures

ARRANGEMENT FOR METERING THE INK QUANTITY IN INKING UNITS ON PRINTING PRESSES

One common type of ink fountain employs a metering assembly in the form of a series of flat slides arranged side by side in coplanar relation with their lateral edges adjacent one another so that the presented front edge is substantially continuous, with means at the rear end of each slide for individually adjusting the position of the slide with respect to the fountain roller thereby to meter ink in predetermined thickness in respective zones. Typical arrangements of this type are disclosed in Cappel et al. prior U.S. Pat. Nos. 3,895,575, 3,913,479, and 3,978,788. In each case the tip portions of the blades are either formed of, or covered by, resilient plastic for a number of reasons, the primary reason being to prevent damage to the smoothly surfaced fountain roller when ink feed is silenced by closing the gap in selected ones or in all of the column positions. At the time these constructions were devised it was assumed that the ink would serve as a lubricant to preserve the presented edges of the slides against wear in both their open and closed (zero gap) positions.

However, experience has shown that the metering edges are indeed subject to wear, sometimes at an aggravated rate, depending upon the type of ink being used. The wear problem is particularly acute when using that class of inks which are intended to be dried by ultraviolet radiation. The wear problem has persisted notwithstanding the substitution of resilient plastic materials of the most durable type.

Wear at the metering edges of the slides tends to degrade the metering accuracy of the fountain, particularly since it tends to occur irregularly and since it destroys the slide calibration. Using relatively stiff plastic materials in an effort to reduce the amount of wear has made it necessary to apply large amounts of force in the closing direction when it is desired to silence the ink flow in selected ones, or in all, of the column positions. This in turn has risked overloading of the gap adjusting mechanisms associated with each of the slides.

It is, accordingly, an object of the invention to provide an ink fountain of the type employing separately adjustable slides in which the metering function is performed more efficiently and is subject to a more sensitive adjustment than in conventional fountains. It is a related object to provide an ink fountain in which wear at the metering edge is substantially eliminated both under conditions of ink feed and under conditions where selected ones, or all, of the slides are in closed position to shut off the feeding of ink. It is a more specific object to provide an ink fountain of the type employing adjustable slides which exhibits freedom from wear, both on the metering edges of the slides and upon the surface of the fountain roller, regardless of the ink being employed and even using inks of the type intended to be dried by ultraviolet light.

It is another object of the invention to provide an ink fountain having adjustable slides in which the calibration of the slides, that is, the thickness of the ink feeding gap as related to the position of the slide, remains substantially unaffected by wear so that re-calibration, readjustment or replacement is not required over long periods of usage.

It is another object of the present invention to provide an ink fountain employing adjustable slides for the metering of ink and which are capable of being moved to closed sealing engagement with respect to the surface of the fountain roller to shut off the flow and in which it is capable of establishing a sealed condition, for complete cut-off of the ink, with only a limited reaction force being exerted between the slide and the fountain roller thereby to minimize wear at the engaging surfaces and to avoid straining the adjusting mechanism.

It is a general object of the present invention to provide an ink fountain employing improved slides which can be economically made and installed, slides which are completely interchangeable and which do not require maintenance or adjustment over long periods of usage.

Other objects and advantages of the invention will become apparent upon reading the attached detailed description and upon reference to the drawings in which.

While the invention has been described in connection with several preferred embodiments, it will be understood that we do not intend to be limited to the particular embodiments shown but intend, on the contrary, to cover the various alternative and equivalent forms of the inventions included within the spirit and scope of the appended claims.

Figure 1:
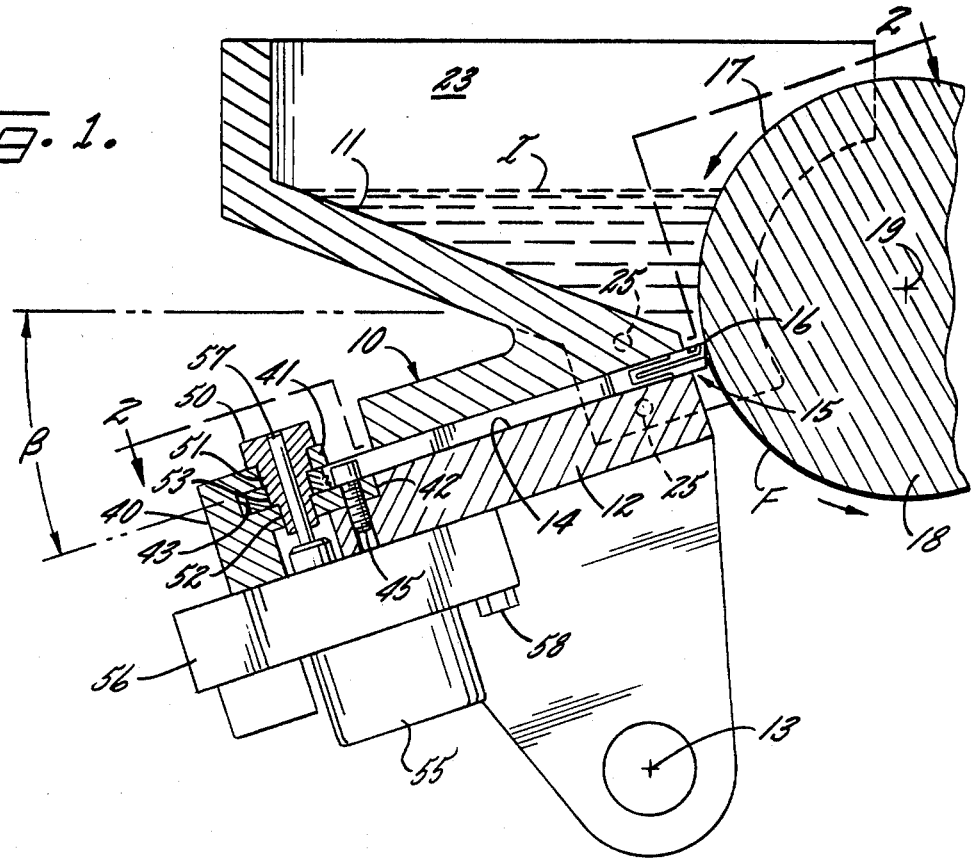
FIG. 1 is a vertical section taken through an ink fountain embodying the present invention looking along the line 1—1 in FIG. 2.

Turning now to FIG. 1 there is shown an ink fountain having a frame 10 which includes an upper trough portion 11 and a lower or base portion 12. The portions are hinged together for relative movement about a hinge axis 13. The two portions, between them, define a generally horizontal slot 14. Fitted in the slot is a metering assembly 15 having a presented front edge 16 which cooperates with the surface 17 of a fountain roller 18, the plane of the metering assembly preferably falling close to the axis 19 of the roller.

Figure 2:
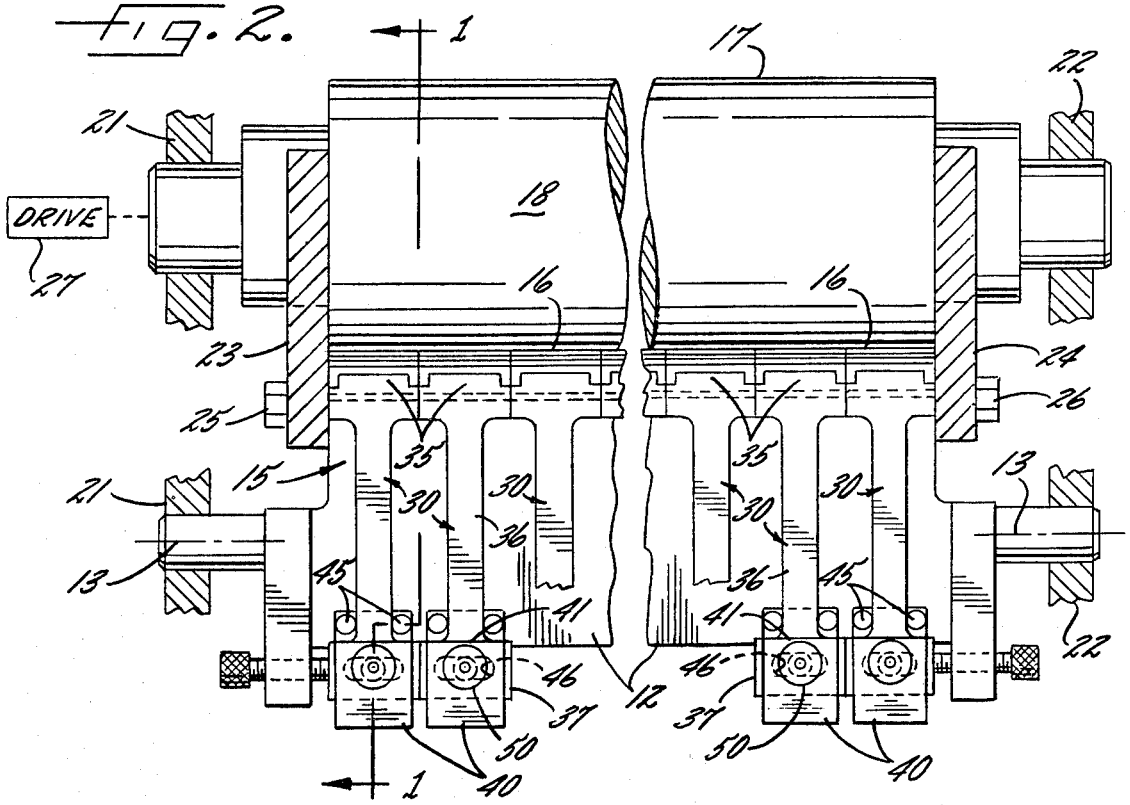
FIG. 2 is a fragmentary plan view of the metering assembly looking along the line 2—2 in FIG. 1 showing the slides defining zones of adjustment.
Figure 3:
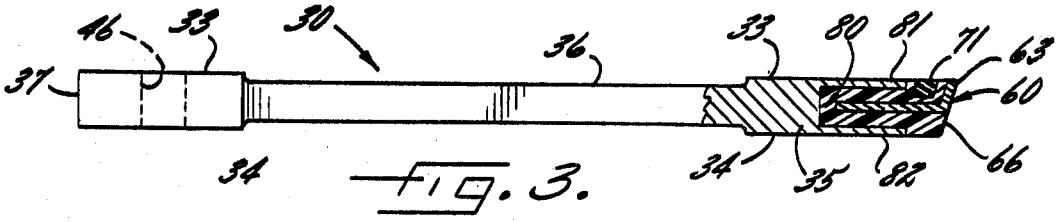
FIG. 3 is an edge, or elevational, view of one of the slides in partial section taken along line 3—3 in FIG. 4.
Figure 4:
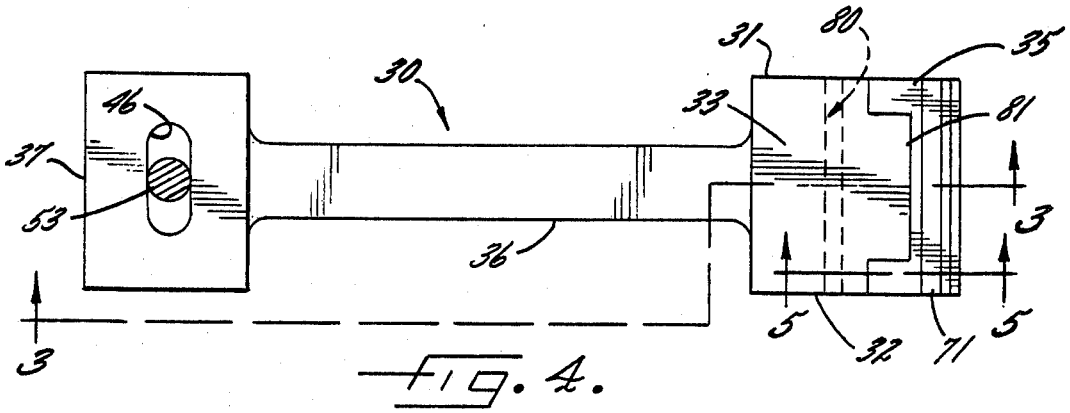
FIG. 4 is a plan view of the slide shown in FIG. 2.

The ends of the fountain roller are journaled for rotation in end members 21, 22 of the frame which are shown fragmentarily in FIG. 2. Spaced inwardly from the members 21, 22 are end plates 23, 24 secured by screws 25, 26. The end plates, which are shown in profile in FIG. 1, bear against the respective ends of the metering assembly 15 as well as against the ends of the fountain roller and the ends of the upper and lower members 11, 12 to define a trough which carries a body of ink I. When the fountain roller is rotated in the direction shown, by means of a drive 27, so that the roller surface 17 passes downwardly through the body of ink, a film of ink F is established on the fountain roller, the thickness of which at each point depends upon the clearance between the metering assembly and the roller surface.

The metering assembly 15 is in the form of a series of flat slides arranged side by side in coplanar relation, with their lateral edges lying closely adjacent one another. Taking one of the slides 30 as typical, and as set forth in FIGS. 2 to 5, the slide has lateral edges 31, 32 which are parallel to one another, and top and bottom surfaces 33, 34 which are also flat and parallel. The slide has a front end, or tip, portion 35, a shank or body portion 36 and a rear end portion 37. The body is preferably cut out, or relieved, over the major length of the slide so that the lateral edges 31, 32 are in engagement with the adjacent slides only at the respective ends of the slide. Each slide is, in short, of slightly "dumbbell" profile.

Each slide is not only independent of all of the other slides, but has individual means for adjustment. To this end each of the slides is supported at its rear end upon a bracket or bearing housing 40 having parallel portions 41, 42 which define between them a slot 43 in which the rear end of the slide is snugly slidable. The bracket is secured to the base portion 12 of the frame by means of screws 45. For determining the endwise position of the slide, each slide has a transverse slot 46 formed in its rear end engaged by a rotatable bushing 50. The bushing has upper and lower bearing portions 51, 52 which are coaxially fitted in the opposed portions 41, 42 of the bracket, as well as a central eccentric portion 53 which mates with the slot 46. The bushing is rotated by a motor 55 having a gear box 56 and an output shaft 57 to which the bushing is secured. The gear box and motor are secured to the base portion of the frame by screws 58.

In accordance with the present invention the front portion of each slide 30 has embedded therein a blade of wear resistant spring metal, the blade being coextensive with the width of the slide and so oriented in the slide as to present a flat face of the fountain roller, defining with the fountain roller a sharply acute cusp so that when the slide is slightly retracted from the fountain roller a gap is created for the metering of ink and so that when the slide is advanced to close the gap the blade bears against the surface of the fountain roller flexing broadwise resiliently and accommodatingly to achieve a seal between the plate and the fountain roller with only a limited reaction force being exerted between them. More specifically in accordance with the invention each slide has a rectangular tip portion formed of resilient plastic, the blade of spring metal being embedded therein, and the tip portion being relieved in the region just behind the metal blade to accommodate the flexing thereof.

Thus the tip portion 35 of the slide is formed of a generally rectangular phase of resilient plastic which may, for example, be a polyamid resin, specifically that which is commercially available as nylon, although it will be apparent to one skilled in the art that plastics of similar durability, elasticity and dimensional stability may be used. Embedded in the plastic and extending the width of the slide is a blade of spring metal 60 which is preferably of "L" shape having a long horizontal leg 61 which serves to anchor the blade in the plastic material and a relatively short yet flexible leg 62 which extends upwardly, with the edge 63 thereof being substantially flush with respect to the upper surface 33 of the slide. The flexible portion 62 of the blade is oriented in the slide so as to present a flat face 64 to the surface 17 of the fountain roller, defining with the fountain roller a sharply acute cusp 65.

Preferably the plastic tip portion 35 of the slide is relieved in the region just behind the metal blade 60 to accommodate resilient flexing of the blade thereby to achieve a seal between the blade and the fountain roller with only a limited reaction force being exerted between them. Such relief is preferably achieved by forming a transverse groove 70 behind the upstanding portion of the metal blade (see FIG. 5) and by filling the groove with a yieldable strip 71 of a soft material which may, for example, be formed of extremely soft rubber or rubber-like plastic either in solid form or in foam of the closed cell type.

Figure 5:
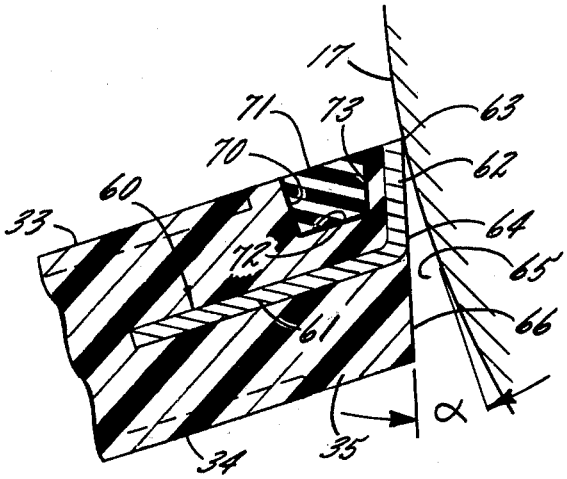
FIG. 5 shows the enlarged tip portion of one of the slides as viewed along line 5—5 in FIG. 4.
Figure 6:
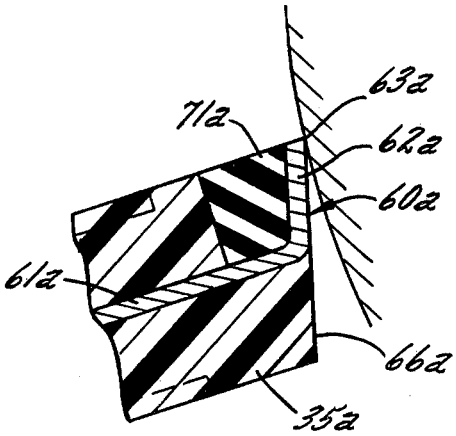
FIG. 6 is a view similar to FIG. 5 but showing a slightly modified construction.

In the preferred form of the invention illustrated in FIG. 5, the groove 70 has a bottom wall 72 and a front wall 73 formed in the same plastic which forms the tip portion 35 of the slide. Such structure is appropriate where the plastic of which the tip portion is made is limber rather than stiff. However, to accommodate free flexing of the spring metal blade to maximum degree and at a low spring rate, a modified structure may be employed as shown in FIG. 6 where corresponding reference numerals are employed to denote the same elements with addition of subscript a. In this construction the walls 72, 73 are omitted and the strip **71*a* of soft material is extended into direct contact with the horizontal and vertical portions of the spring metal blade 60*a***.

In accordance with one of the aspects of the present invention the front end of the slide, indicated at **66, 66*a*, may be angularly undercut by an angle $\alpha$ to insure that clearance exists below the front edge of the spring metal blade even when the metering assembly is, as shown in FIG. 1**, angled upwardly by an angle $\beta$ with respect to the horizontal.

The plastic tip portion 35 of the slide, and which is of generally rectangular shape, is preferably inserted into a socket 80 formed at the front end of the body, or shank, 36. The socket preferably consists of parallel "jaws" 81, 82 which engage, and which are recessed in, the upper and lower surfaces, respectively, of the inserted tip portion 35. By recessing the jaws 81, 82 so that they are flush, by causing the front surface 66 to be flush with the vertical portion 62 of the spring metal blade, and by making the soft strip 71 flush with the top surface of the groove 70, each slide presents only planar surfaces which are easily cleaned and which are free of nooks and crannies in which dried ink may collect.

Figure 7:
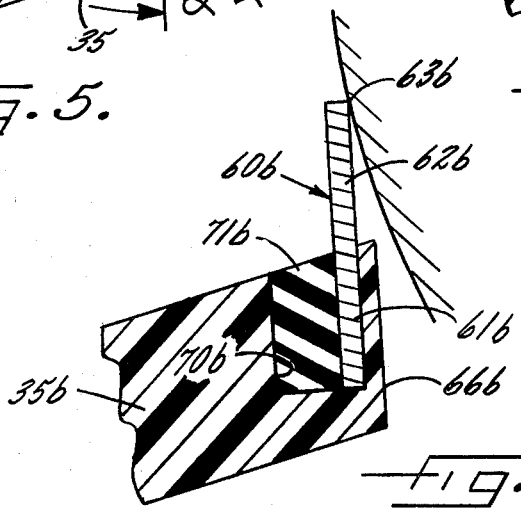
FIG. 7 is a view similar to FIG. 5 but showing a further modification.

While it is preferred to make the spring steel blade 60 of "L" shape as illustrated in FIGS. 5 and 6, the invention is not necessarily limited thereto and a blade of planar construction may be employed, anchored cantilever-fashion, as illustrated in FIG. 7 in which the same reference numerals, with addition of subscript b, have been used to denote similar parts. In this construction the plastic tip portion **35*b* has a groove 70*b* in which is anchored a blade 60*b* of spring metal having a lower, or anchoring, portion 61*b* and an upwardly extending, flexible portion 62*b*. The groove 70*b* is completely and flushly filled with a yieldable strip of soft material and the anchoring portion 61*b* of the plate is preferably secured to the front wall 66*b* of the slide. Except for the fact that the spring metal blade extends upwardly from the top surface of the slide, the version shown in FIG. 7** has substantially the same features and advantages of that earlier described.

The blade 60 (**60*a*, 60*b***) has been referred to as being made of "spring metal". The blade is preferably made of a thin wafer of spring steel, although it will be apparent to one skilled in the art that other springy metals may be substituted therefor as, for example, phosphor bronze.

The structure described above has been found to have a much greater degree of wear resistance than the constructions illustrated in the cited prior patents, both in the ink feeding and in the shut-off condition, and regardless of the type of ink which may be employed, thereby amply fulfilling the objects set forth above. When the slide is adjusted to a slightly backed-off position to form a gap for metering of ink it is found that the ink, even over long periods of time, produces no detectable wear upon the edge of the spring metal blade. Under conditions of ink feed the blade simply serves as a metering edge and remains in an unflexed condition. Nor is there any appreciable wear when the slide is in its closed or blocking state in which the metering edge is in contact with the surface of the fountain roller. In the course of such contact, which is achieved by the adjusting mechanism at the rear end of the slide, the edge of the blade bears against the surface of the fountain roller flexing broadwise resiliently and accommodatingly to achieve a seal which extends along the closed length of the metering edge in spite of any imperfections which may exist along the edge or on the engaged surface of the fountain roller. In short, it is possible to achieve a perfect "zero gap" with only a limited reaction force being exerted between the engaged surfaces, a force which is much less than that required to produce a seal where slides of prior construction are employed. Reduction in the reaction force required for sealing has two benefits, wear between the metering edge and the surface of the fountain roller is minimized and there is no possibility of straining the adjusting mechanism. As a result, the need for maintenance or renewal, due to wear, is minimized and the calibration of the slides remains constant and reliable over long periods of time.

What we claim is:

1. In an ink fountain combination comprising a frame defining a generally horizontal slot having parallel walls, a fountain roller rotatable in the frame adjacent the slot and having means for slowly driving the same, a metering assembly mounted in the slot and having a presented front edge arranged in abutting relation to the surface of the roller, the frame being shaped to support a body of ink adjacent the metering assembly so that a film of ink is formed on the roller by the assembly as the roller is rotated, the metering assembly being in the form of a series of flat slides fitted in the slot and arranged side by side in coplanar relation with their lateral edge lying closely adjacent one another so that the preferred front edge is substantially continuous, means at the rear ends of the respective slides for individually adjusting the position of each slide with respect to the fountain roller thereby to meter ink in predetermined thickness in respective zones upon the foundation roller, the front portion of each slide having embedded therein a blade of wear-resistant spring metal, each said slide having a tip portion formed of a generally rectangular piece of resilient material, the tip portion of each slide being relieved in the region just behind the blade to accomodate rearward flexing movement of the blade, such relief being provided by a transverse groove substantially filled with a yieldable strip of soft material flush with the top surface of the groove such that each slide presents only planar surfaces free of nooks and crannies behind the blade, the blade being coextensive with the width of the slide and so oriented in the slide as to present a flat face to the fountain roller defining with the fountain roller a sharply acute cusp faced in such direction that the surface of the roller moves out of the cusp so that (a) when the slide is slightly retracted from the fountain roller in a metering mode a gap is created for the feeding of a film or ink on the roller surface at a metered rate which depends upon the degree of retraction and so that (b) when the slide is advanced to close the gap in a sealing mode the edge of the blade bears against the surface of the fountain roller flexing broadwise resiliently and accommodatingly to achieve a seal between the blade and the fountain roller with only a limited reaction force being exerted between them.

2. The combination as claimed in claim 1 in which the front end of the slide which is presented to the fountain roller is undercut to insure clearance below the front edge of the spring metal blade.

3. The combination as claimed in claim 1 in which the blade has an anchoring portion which is embedded in the tip portion of the slide and a flexing portion which extends upwardly therefrom for engagement with the surface of the fountain roller in the sealing mode.

4. The combination as claimed in claim 1 in which the spring metal blade is bent into "L" configuration defining a relatively long anchoring leg which is embedded in the tip portion of the slide and which extends generally horizontally therein and a short flexible leg which extends upwardly with the edge thereof being substantially flush with respect to the upper surface of the slide.

5. The combination as claimed in claim 4 in which the slide has a transversely extending groove behind the flexible leg of the metal blade, the groove containing a yieldable strip of soft material to accommodate flexing of the metal blade when the blade is brought into engagement with the surface of the fountain roller in the sealing mode, the strip of soft material being flush with the upper surface of the slide.

* * * * *